US006907828B2

(12) United States Patent
Ruocchio

(10) Patent No.: US 6,907,828 B2
(45) Date of Patent: Jun. 21, 2005

(54) MODEL TRAIN CARS

(76) Inventor: Albert C. Ruocchio, 429 Chadwick Dr., Raleigh, NC (US) 27609-4561

( * ) Notice: Subject to any disclaimer, the term of this patent is extended or adjusted under 35 U.S.C. 154(b) by 0 days.

(21) Appl. No.: 10/180,136

(22) Filed: Jun. 27, 2002

(65) Prior Publication Data

US 2004/0000252 A1 Jan. 1, 2004

Related U.S. Application Data

(60) Provisional application No. 60/301,472, filed on Jun. 29, 2001.

(51) Int. Cl.[7] ..... B61D 17/00

(52) U.S. Cl. ..... 105/396; 105/238.1; 105/248

(58) Field of Search ..... 105/238.1, 238.2, 105/239, 247, 358, 396, 360, 1.3, 397, 248, 404; 72/254; 29/527.5, 525.11, 897.2, DIG. 47; 296/901, 181; 298/24; 414/303

(56) References Cited

U.S. PATENT DOCUMENTS

| | | | | | |
|---|---|---|---|---|---|
| 2,044,735 | A | | 6/1936 | Pelton | |
| 2,108,416 | A | | 2/1938 | Smith et al. | |
| 2,286,954 | A | | 6/1942 | Clarke et al. | |
| 2,725,668 | A | * | 12/1955 | Bonanno | 446/427 |
| 3,339,499 | A | | 9/1967 | Charles et al. | |
| 3,641,943 | A | | 2/1972 | O'Neill | |
| 4,049,285 | A | | 9/1977 | Chieger | |
| 4,212,405 | A | | 7/1980 | Schmidt | |
| 4,348,962 | A | | 9/1982 | Smith | |
| 4,633,787 | A | | 1/1987 | Przybylinski et al. | |
| 4,800,820 | A | | 1/1989 | Tomaka | |
| 4,947,762 | A | | 8/1990 | Perzl et al. | |
| 5,433,501 | A | | 7/1995 | Thomas et al. | |
| 5,467,718 | A | * | 11/1995 | Shibata et al. | 104/284 |
| 5,787,585 | A | * | 8/1998 | Rashid | 29/897.2 |
| 6,073,993 | A | | 6/2000 | Iwatsuki et al. | |
| 6,148,735 | A | | 11/2000 | Sauter et al. | |
| 6,213,449 | B1 | * | 4/2001 | Portis et al. | 251/144 |
| 6,241,310 | B1 | | 6/2001 | Patelczyk | |
| 6,302,031 | B1 | * | 10/2001 | Smith et al. | 105/404 |

OTHER PUBLICATIONS

Hubbard, John, The Story of Willias Electric Trains, 1987 pp. 39–41, 64, 68.*

Wagner, Dave, *Mainline Modeler,* Nov. 1984, pp. 71–76.

Hubbard, John, *The Story of Williams Electric Trains,* 1987 pp. 39–41, 64, 68.

Ponzol, Dan, *Lionel: A Century of Timeless Toy Trains,* Friedman/Fairfax Publishers, NY, NY 2000.

* cited by examiner

*Primary Examiner*—Frantz F. Jules

(74) *Attorney, Agent, or Firm*—Law Offices of Royal W. Craig

(57) ABSTRACT

A model train freight car and a method of manufacturing the same. An aluminum model freight train car body is extruded through a die. At least one accessory is attached to the freight car body. The model train freight car weight ranges from about 1.0 lbs. to about 1.75 lbs., and is free from flow lines and seams

16 Claims, 8 Drawing Sheets

MODEL TRAIN CARS

CROSS-REFERENCE TO RELATED APPLICATION

This application claims priority from provisional application No. 60/301,472, filed Jun. 29, 2001 and incorporated herein by reference.

BACKGROUND OF THE INVENTION

Discussion of Prior Art

Since the objective, in many cases, in the model toy train industry is to replicate "real trains," that is, to faithfully reproduce various actual historical engines, passenger cars and freight cars, it is worthwhile to review the construction of real trains.

Traditionally, real train cars have primarily been manufactured with various types and forms of metal, notably steel, and, in some applications, wood has been utilized, as in the siding of boxcars. Thick plates or sheets of metal were often used in freight cars to provide a strong, durable container body that would hold up to the weight of the load and the jarring movements during transportation. Over time, there was a movement to produce lighter weight cars by reducing the thickness of the metal underframe and sidewalls. An article in the November 1984 issue of *Mainline Modeler* entitled "Alton Aluminum Box Car" gives account of the real Alton Aluminum Boxcar produced using aluminum panels and some steel parts instead of being produced entirely of steel. When the Alton Aluminum Boxcar was introduced in 1945, some interest was generated, but overall, the cars were not considered successful because of problems with deterioration. Cylindrical cars, such as the tank car, were often made of die cast metal welded together or sheets of metal with interior braces for support. U.S. Pat. No. 2,108,416 shows a cylindrical tank shell constructed of sheets.

Hopper freight cars generally have one of two types of construction: those with straight vertical sides with vertical frames and metal panels and those with arcuate, curved sides and, in at least some cases, formed of a single metal sheet or panel. U.S. Pat. No. 4,212,405 outlines a cargo container or trailer with a body consisting of a floor, two ends and two opposing sides made of aluminum alloy plate with beam members. U.S. Pat. No. 3,339,499 utilizes a smooth arcuate side plate on each side of the car. In some cases, extruded aluminum has been used for the construction of interior posts or beams used to support the sidewall and frame of the train car body. U.S. Pat. No. 5,433,501 discloses a container or trailer sidewall having a plurality of vertical sections with each section having a hollow, tubular extruded aluminum post.

U.S. Pat. No. 4,049,285 discloses the use of aluminum extrusion for construction of the floor. The platform trailer discussed therein consists of numerous floor boards made of extruded aluminum joined together to form the floor.

Another feature of railroad freight cars worth mentioning is an interior side sill that connects the sidewalls to the floor assembly. Although aluminum extrusion has been used in some construction designs of side sills, none have been formed in conjunction with or as part of an extruded sidewall.

As seen in U.S. Pat. No. 2,286,954, the side sill is an important feature for both lateral and horizontal support and a focus of strength in the overall construction. While U.S. Pat. No. 4,348,962 mainly relates to bolster assembly construction, it also shows a hopper whose body is defined by opposing arucate side sheets with a side sill structure extending along the lower length of each side sheet.

U.S. Pat. No. 3,641,943 has a sill arrangement which forms a part of the side frame and is joined to a channel member which is part of the underframe assembly. The sill creates a beam running the length of the car. The extruded side sill member is attached to and supports transverse members. The channel members are constructed of a one-piece aluminum construction, but are produced separately from the side wall.

U.S. Pat. No. 4,633,787 discloses a light weight gondola having a cargo carrying structure of welded aluminum. The side sill members are formed of extruded aluminum. The material used for the sidewalls is an aluminum alloy sheet welded to the side sills and extruded aluminum frame. Support members in the form of vertical beam act as frame and are extruded aluminum alloy.

Use of aluminum extrusion has also been explored in the manufacture of other types of vehicular applications. U.S. Pat. No. 5,787,585 and U.S. Pat. No. 6,073,993 disclose a frame or compartment of a vehicle body using a tubular structure.

Model Train History

Throughout model train history, most manufacturers have used a variety of construction methods and materials which are dependent upon the technology available and the suitability for specific types of model train cars. Lionel Manufacturing Company's first train production in 1900 was a wooden train with a motor concealed below the floor. It was common in the 1910's and 1920's for manufacturers to use heavy gauge sheet metal which was readily available, relatively easy to work with and inexpensive.

In the 1920's, metal die casting became an increasingly desirable method of construction. The heavy weight of die cast trains lends to the perception by the consumer of a quality product. In 1925, Dorfan, Inc. was the first manufacturer to make trains of zinc alloy die cast. Other model train companies soon followed suit. Until 1934, most model train engines used some die castings for trim, but the engines themselves were built mostly from formed sheet metal. The increase in die cast usage allowed for more detail in the model train product.

Several other innovations around the 1930's were reflected in model train production. High quality metal stamping also added more detail.

Steel was common in the 1930's and was, therefore, another material used to build model trains. Pressed metal and tinplate construction, which had been used for a number of years, continued to be popular in the 1930's. Overall, the model train industry was expanding, a natural result of which was exploration of new techniques and designs. Another innovation, which the model train industry explored and expanded upon late in the 1930's and into the 1940's, was the use of plastics and the process of injection molding plastics. Plastic trains are still very common, especially for manufacturing freight cars and passenger cars. However, engines can also be constructed of molded plastic. Recently, manufacturers have used plastic molding to achieve a high degree of detail in the body of a car and have abandoned extruded aluminum for manufacturing model train passenger cars. Brass has also been used and continues to be used to manufacture model train cars, particularly engine and pass cars.

Although numerous technologies and various materials have been used for model electric train production, there has been limited use of aluminum extrusion in manufacturing and no use of aluminum in non-passenger cars. The first metal passenger cars were very simple and plain extruded cars. Because of limitations in technology, very few details could be added. Kusan Model Trains, later known as American Model Toys, produced the first extruded aluminum passenger cars in the late 1940's. Shortly thereafter, in the 1950's and early 1960's, Lionel also produced an extruded aluminum passenger car. Later, in the 1980's, Williams produced a passenger car model called the Metroliner which included interior slots to hold the window material and floor, but unfortunately, this car did not sell well. The passenger cars produced by Williams were reproductions of the Lionel cars from the 1950's. As improvements in plastic technology increased, manufacturers have turned to plastic molding to achieve a high degree of detail in the body of a car as compared to the perceived limitations of extruded aluminum, and accordingly, this technology has been overlooked by the industry in general.

It is also noted that there is a strong distinction in the design and manufacture of passenger cars as compared to freight cars. In both real railroadry and model railroadry, but particularly in the model railroad industry. Freight car trains are used to transport raw materials or products to manufacturing site, markets, seaports, etc. Passenger car trains are used to transport people and their possessions to specific locations. In this regard, baggage cars are passenger cars, particularly in the model railroad industry. The design of passenger and freight cars of passenger and freight trains reflect the divergent functions of each of the trains. Passenger cars are longer and lighter and have a higher aesthetic appeal. Further, the passenger cars of passenger trains usually "match" one another. Freight cars of freight trains are designed to maximize strength, space, and durability and have unique designs to accommodate the type of product that they will be carrying. Various types of train cars that would be considered freight cars are hoppers, tanks, flat cars, gondolas, stock cars, auto loaders, coal cars, ore cars, refrigerator cars, vat cars, and cabooses. Finally, engines are considered a further type of train car, separate from freight cars and passenger cars. All types of train cars which are not passenger cars are defined as "non-passenger cars."

SUMMARY OF THE INVENTION

Despite the wide use, previous methods of manufacturing model trains with plastics or die casting have had limitations.

First, plastic can be too light. Not only do the cars not feel heavy enough to accurately mimic the real cars, which are made of metal, but plastic cars also have a difficult time staying on the track. The rolling friction of pulling additional cars behind the plastic cars pulls the plastic cars off the track when rounding curves.

Second, the die cast cars are very heavy. Often, the model train engines are slowed down or unable to pull a long train of the die cast cars because the engines lack sufficient traction.

Third, the molded plastic and die cast cars often have visible seams where the two halves of the mold meet. This results in models that do not look like real trains. Even for a model, this is not aesthetically pleasing.

The problems of the prior art are resolved in the present invention, wherein the freight or other non-passenger car body is produced with extruded aluminum. The aluminum construction results in a weight that avoids the problem of the engine pulling cars of a long train off the track, while not being so heavy that the engine lacks sufficient traction to pull the train. Particularly, the model freight car of the O-gauge type can vary in weight from approximately 1.0 lbs. to approximately 1.75 lbs. Preferably, the weight of the hopper freight car is 1.4 lbs. and the tank freight car is 1.2 lbs.

In addition, this process creates a very smooth and appealing appearance without seams or flow lines. The metallic nature of the aluminum gives a realistic, prototypical look to the model, an attribute very desirable in the model train industry.

Another benefit of the extrusion process is the formation of grooves, indents, sills, ledges, and other features, which can be created in the mold or die design of the extrusion process to enhance the construction and appearance of the model train car. Some exterior sides of model freight cars are smooth, while other model freight cars have fluting or ribs. Fluting gives the appearance of long continuous stripes down the length of the model train car. Using extrusion, this feature is easy to produce by using a series of protruding areas in the design. In addition, there are several other features that can aid in the construction or assembly of the model freight car. One such feature is an interior side sill or interior grooves that can be used for several functions, such as to secure the floor section of the train car or to secure hoppers to the model train car body. Exterior grooves or indentations can be used to attach additional exterior accessories, such as ladders, handrails, grabrails, platforms, brake wheel, and the like.

Aluminum extrusion is easily cut, drilled or punched. Cuts in the extruded piece create a desired shape. As in the case of a model hopper car, the sides of the model train car can be cut after extrusion to form and replicate the inward diagonal shape of the car. Holes can be punched into the aluminum so that screws can be inserted for attachment of separate sections or accessories. In some cases, a protruding tab in a separate part or accessory can snap into a hole or slot in the aluminum freight car body. Therefore, utilization of punched holes greatly aids in assembly with little visibility of the hole or means of attachment.

The use of extruded aluminum, while not the least expensive construction material, is still viable as a reasonable cost to the manufacturer, which, in turn, allows for a reasonably priced item for consumer purchase.

In particular, two types of freight cars, the tank car and the hopper car, are conducive to the extrusion application because of the cylindrical nature of the tank car and the smooth, uniform sides of the hopper car. The tubular body of a tank car or other similarly shaped item can be extruded in one hollow cylinder to which end caps are added to complete the tank car appearance. Other types of freight cars with either flat or arcuate sides can be produced by flat or slightly curved sections of extrusion. These extrusions have either completely smooth sides or indents, grooves, projected sections, or similar features that run the entire length of the extruded portion.

Utilizing the direct extrusion process, aluminum alloys are melted and cast into ingots or billets. A ram inside a cylinder pushes against a heated, semi-liquid piece of ingot or billet. It forces the softened metal through an opening in a die to form a uniform sheet of aluminum. Cooling rapidly, the body of the freight car is created. The process of metal extrusion offers several advantages. The body of the car has a clean profile and there are no flow lines or seams in the metal. It is the body or shell of the model freight car to which this process is particularly addressed. Manufactured from high quality extruded aluminum, model freight cars more accurately replicate the smooth construction of real trains.

Accordingly, the process therefore creates a flawless and sleek metal body with crisp details. The die of the extrusion apparatus determines the body details.

Molding with plastic or die cast metal enables variations in the appearance. For example, one could mold a door, window, ladder, handrail, steps or other detail. On the other hand, if the shell body is extruded, the length of that extrusion must be uniform and without variation, and accordingly, construction of the freight car must take a different approach. To add these details, a door or window must be cut into the aluminum in the case of a passenger car, but such doors and windows are not required for several types of freight cars. Separately molded or crafted items such as ladders or railings can be added by various means, such as inserting a tab into a slot or hole cut into the aluminum body. A screw can also secure an accessory part by using a hole punched into the aluminum body. Or, a groove can be formed in the aluminum body during the extrusion process in which a separate part can be attached by sliding the part into the groove.

In the case of the tank car, one piece of aluminum is extruded to create the body. Other details, such as the end caps, platforms, hatches or vents can be produced from some other material. The end caps of the model tank car are often die cast.

DETAILED DESCRIPTION OF THE PREFERRED EMBODIMENT

Figure 1:
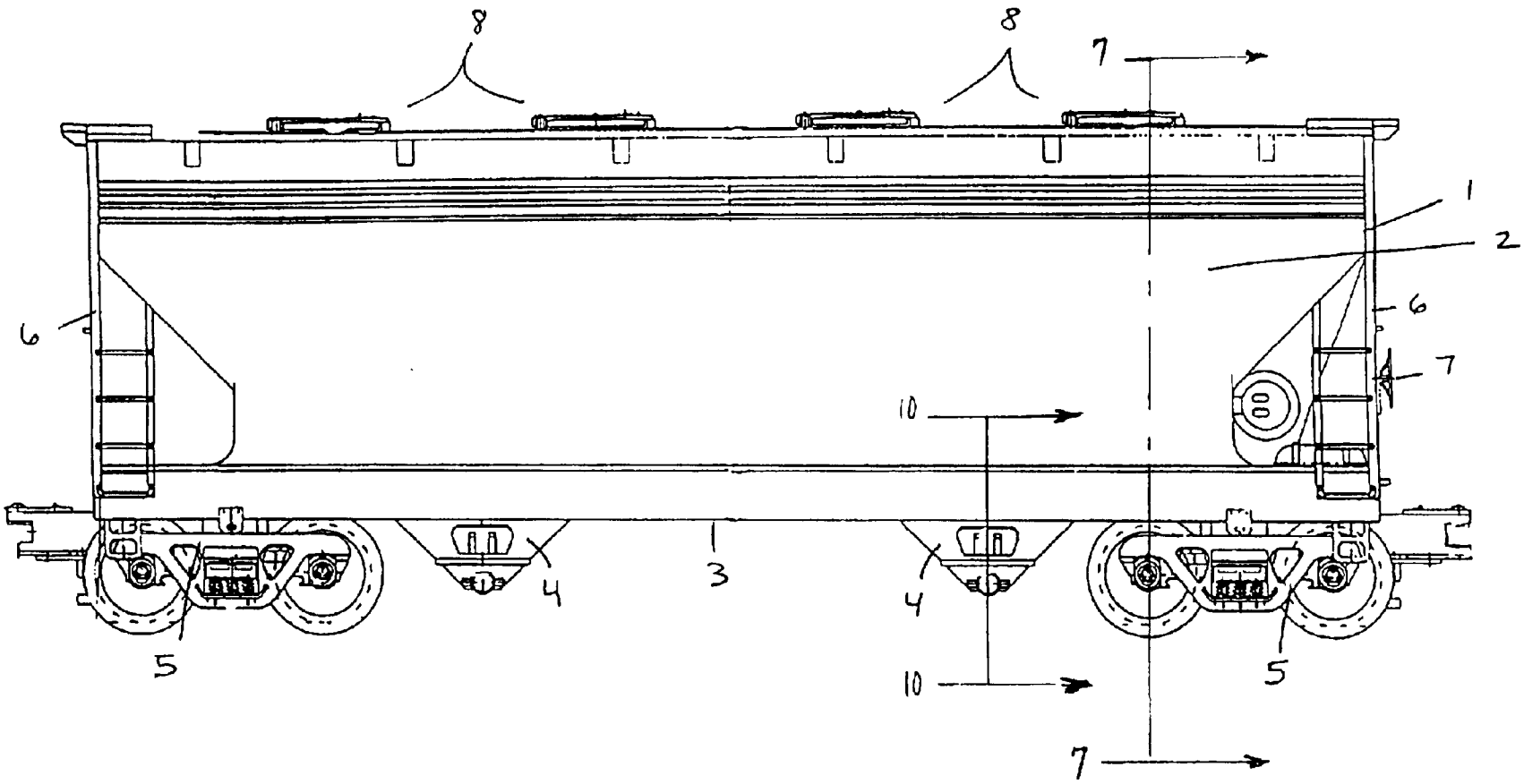
FIG. 1 is a side elevational view of a model train hopper freight car in accordance with the present invention.

As can be seen from FIG. 1, a model train hopper car according to the present invention is referenced generally by the numeral 1. Hopper car side walls 2 and an inner roof section are produced by extruding aluminum to a predetermined length and cutting the extrusion at the ends into a predetermined shape, and then assembling the extrusion together with the car floor 3 and two or more hoppers 4 and truck assemblies 5. Trim, such as ladders 6, brake wheel 7, and roof hatches 8, can also be added.

Figure 2:
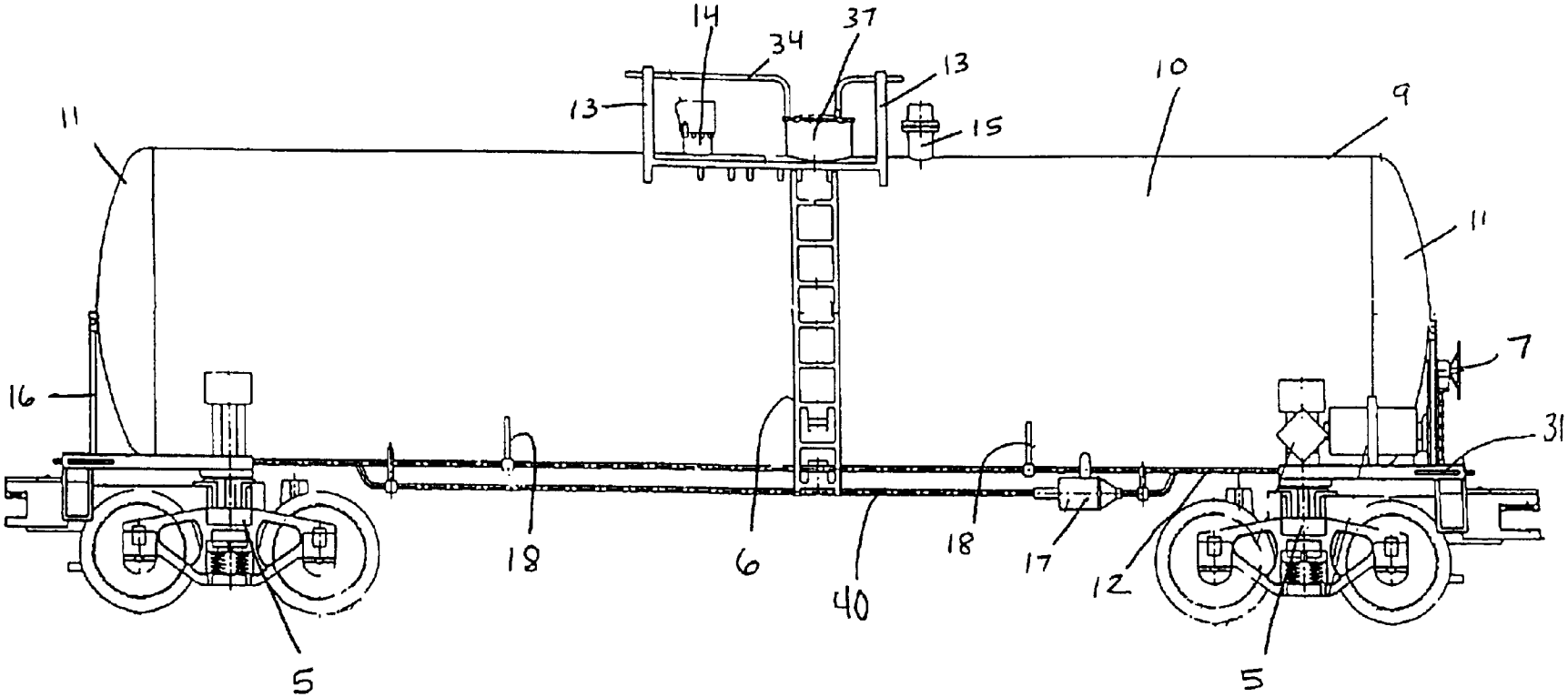
FIG. 2 is a side elevational view of a model train tank freight car in accordance with the present invention.

As can be seen from FIG. 2, a model train tank car according to the present invention is referenced generally by the numeral 9. A hollow cylindrical body 10 of the tank car 9 is produced by aluminum extrusion and cut into a predetermined size and shape. End caps 11 are inserted into each end of the cylinder body 10 and attached to the tank car floor 12. Trim, such as rail platform 13, unleading line 14, safety valve 15, handrails 16, brake wheel 7, brake cylinder 17, and stanchion 18 can also be attached to the tank car body 10. Ladders 6 and truck assemblies 15 are also attached.

Figure 4:
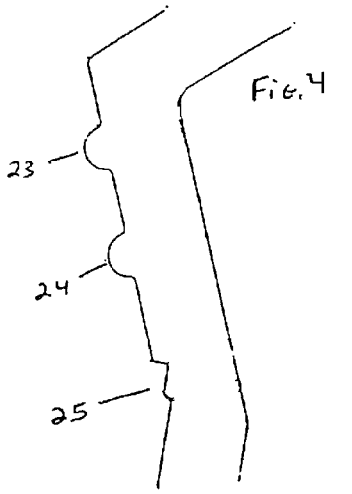
FIG. 4 is an enlarged view of flutes in the extruded model freight car body of FIG. 3.
Figure 5:
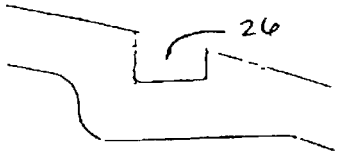
FIG. 5 is an enlarged view of roof groove in the extruded model freight car body of FIG. 3.
Figure 6:
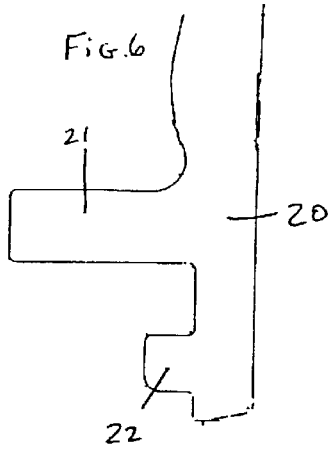
FIG. 6 is an enlarged view of side sills of extruded model freight car body of FIG. 3.
Figure 3:
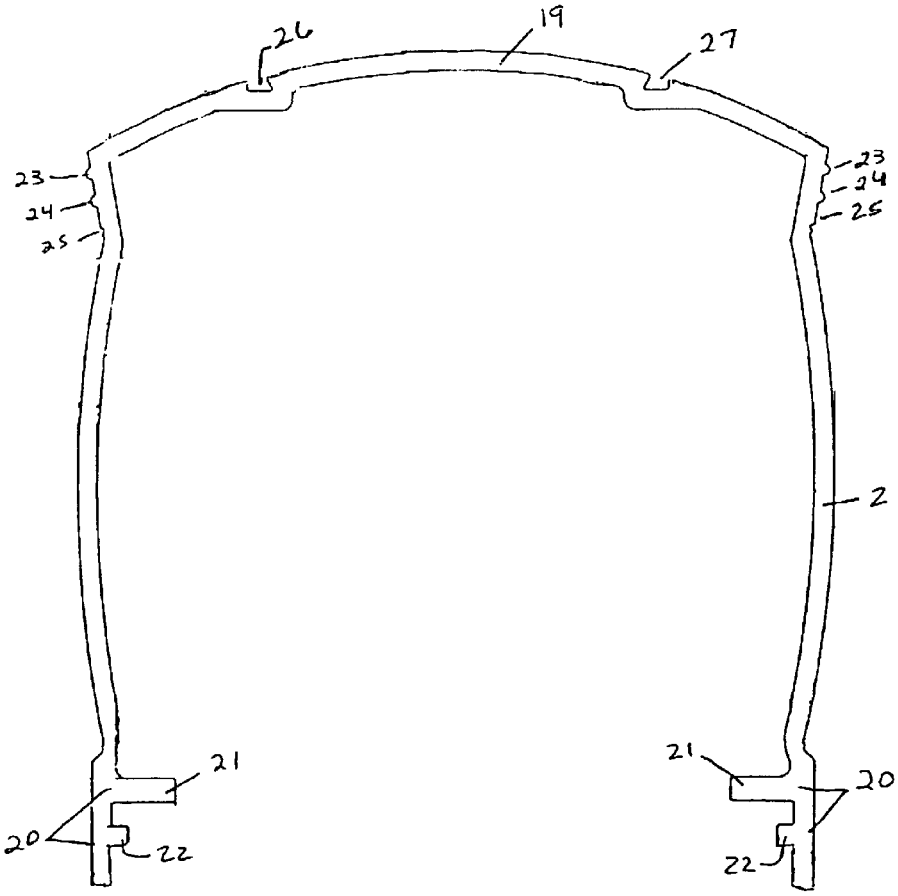
FIG. 3 is a transverse cross-sectional view of the extruded body of the extruded model freight car body of FIG. 1.
Figure 7:
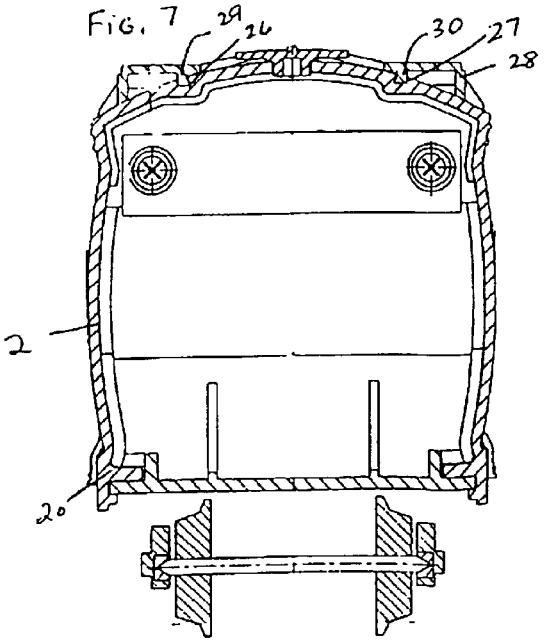
FIG. 7 is a cross-sectional view taken along the line 7—7 in FIG. 1.
Figure 8:
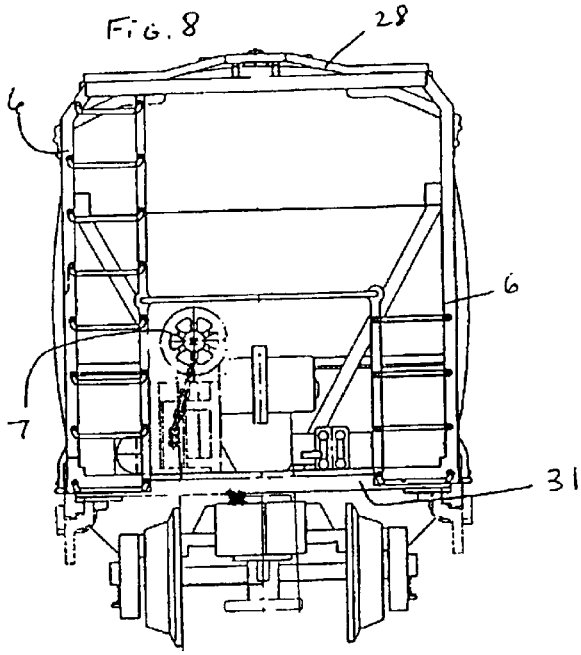
FIG. 8 is an end elevational view of the model freight car of FIG. 1.

FIG. 3 shows a transverse cross-sectional view of the extruded car body of the extruded model hopper freight car body and FIGS. 4–6 show an enlarged view of several features of the extruded hopper freight car body. The hopper car side walls 2 and a hopper car inner roof section 19 formed by the aluminum extrusion are shown in FIG. 3. Each side wall 2 includes a side sill 20 located near the bottom of the wall 2. Two sets of protrusions 21, 22 of the side sills 20 allow a floor section to slide into the grooves formed by the protrusions 21, 22. The protrusions 21, 22 are formed during the extrusion process. Additional connectors can be used, if desired, to connect the floor section to the sides walls 2. However, the extended protrusions of the side sills are is usually sufficient to form is a good connection between the side wall 2 and the floor section and to provide secure support. Protrusions 23, 24, 25 are located near the top of each side wall 2 and run the entire length of the extruded section form. These protrusions 23, 24, 25 are known in railroadry and model railroadry as ribs or fluting. Prototypically, some freight cars are smooth-sided and other freight cars have ribs. The extrusion process can create this external, physical feature of the freight car. Also formed during the extrusion process are two roof grooves 26, 27 that enable an outer roof section to slide into the grooves.

Figure 9:
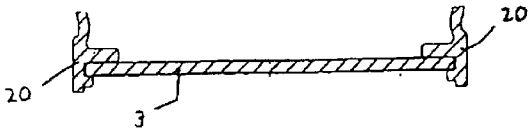
FIG. 9 is a cross-sectional view of the side sills and floor of the model freight car of FIG. 8.
Figure 10:
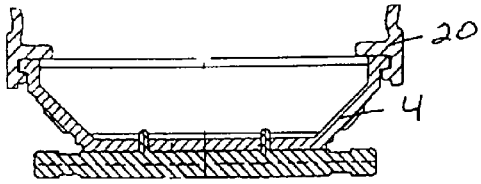
FIG. 10 is a cross-sectional view of the side sill and hopper of the model freight car taken along the line 10—10 in FIG. 1.
Figure 11:
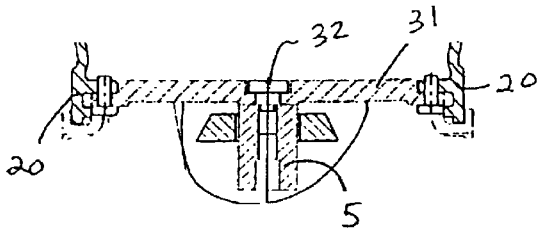
FIG. 11 is a cross-sectional view of the side sill, stanchion and upper portion of the truck assembly of the model freight car of FIG. 1.

FIGS. 7–11 show features of the hopper freight car. An outer roof section can be secured to the freight car body by inserting outer roof protruding inserts 29, 30 into inner the roof grooves 26, 27 formed during the extrusion process. In the particular hopper car shown in FIGS. 7–11, the side sills 20 are utilized to attach three different floor sections. The first floor section, shown in FIG. 9, is a flat floor piece 3. The second floor section, shown in FIG. 10, is the hopper assembly 4 underneath the car body which, when operated, can empty the contents of the hopper car. The third floor section, shown in FIG. 11, is a bolster 31 section which extends from the hopper body. A screw 32 can secure the bolster 31 to the body and truck assembly 5.

Figures 12, 13, 14:
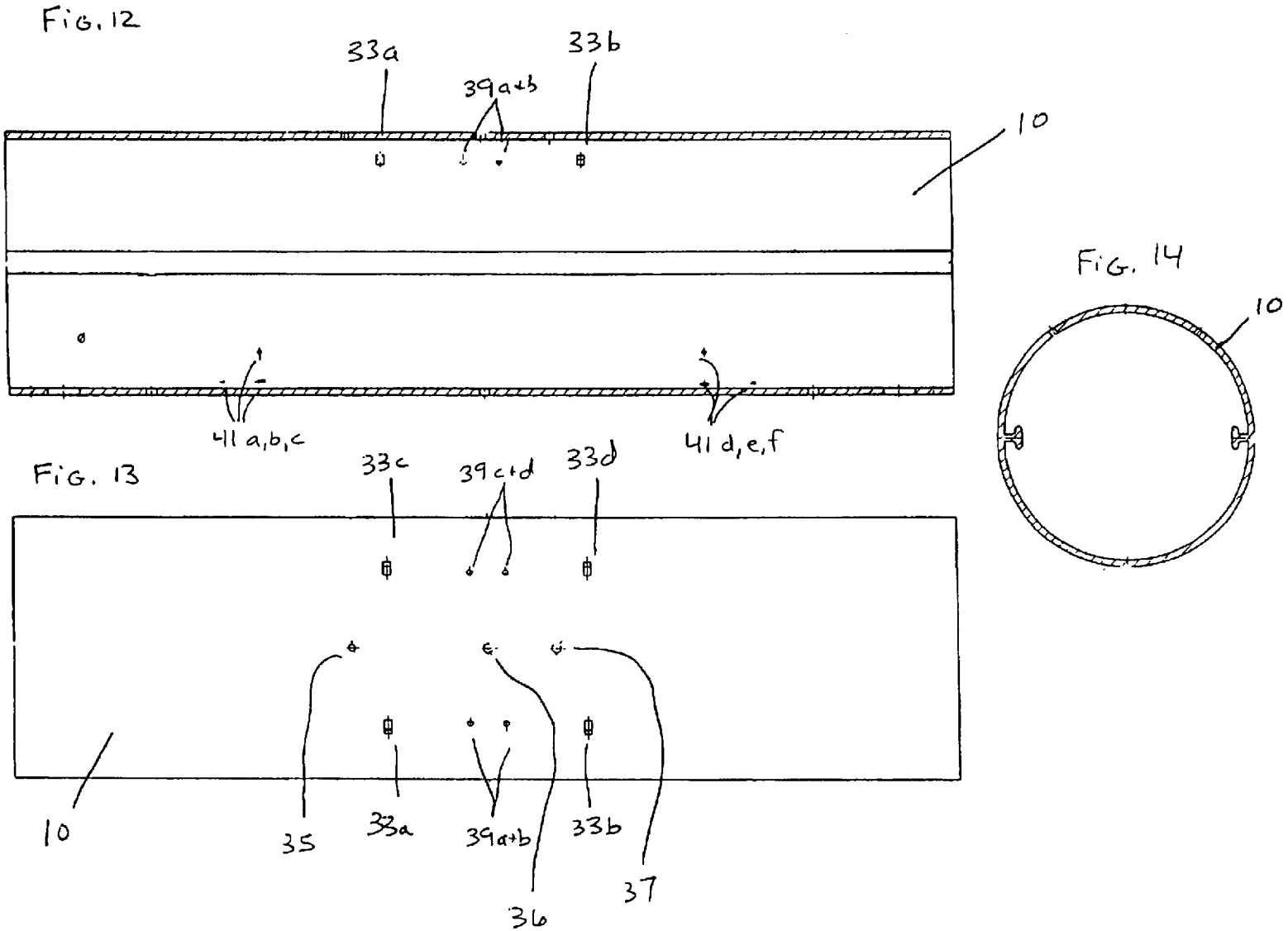
FIG. 12 is a side elevational view of the extruded body of the model train tank car of FIG. 2.
FIG. 13 is a top plan view of the extruded body of the tank freight car of FIG. 12, with holes punched into the aluminum.
FIG. 14 is a transverse cross-sectional view of the tank car body of FIG. 12.
Figure 15:
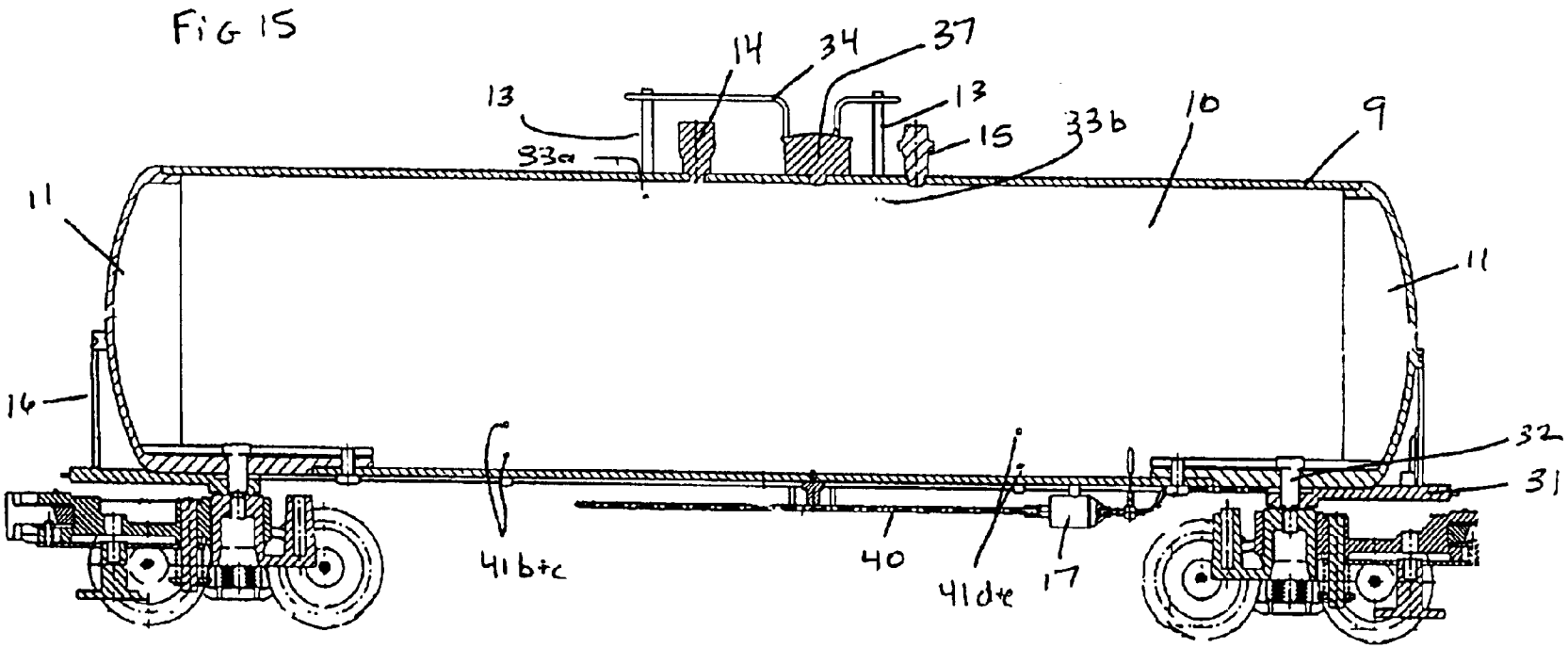
FIG. 15 is a longitudinal cross-sectional view of the tank car of FIG. 2.

FIGS. 12–14 show features of the freight tank car body, and FIG. 15 shows features of the freight tank car. FIG. 14 is a transverse cross-sectional view of the cylindrical tank body formed from one extruded piece. FIGS. 12 and 13 indicate locations of holes punched or drilled into the cylinder body. At the top of the cylinder body, holes 33*a*–*d* allow for the addition of a roof platform and railing 34. An unleading line can be secured to the body with hole 35. A center hole 36 is used to attach a manhole 37, and hole 38 is used to attach a safety valve 15. Holes 39*a–d* are utilized to attach the ladder 6 extending down the length of the side of the tank car. These trim or accessory items can be attached in several ways. Most commonly, a screw would be used, or alternatively, an item could snap into the hole or slot. At the bottom of the tank cylinder, other trim, such as a brake cylinder, pipes 40, and stanchions 18 can be added by attachment with holes 41*a–f* in the tank body.

FIG. 15 is a longitudinal cross-sectional view of the tank car of FIG. 2. Tank car end caps can be inserted into the cylinder of tank car body. Threads can be provided in the end cap and/or the tank body so that the end caps can be screwed into the tank body. The accessories can be added in this way as well. This offers a relatively simple means of attachment.

The aluminum construction of both the model hopper freight car and the model tank freight car results in a weight that avoids the problem of the engine pulling cars off a long train off the track, while not being so heavy that the engine lacks sufficient traction to pull the train. Particularly, the model freight cars of the O-gauge type can vary in weight from approximately 1.0 lbs. to approximately 1.75 lbs. Preferably, the weight of the hopper freight car is 1.4 lbs. and the tank freight car is 1.2 lbs.

Figure 16:
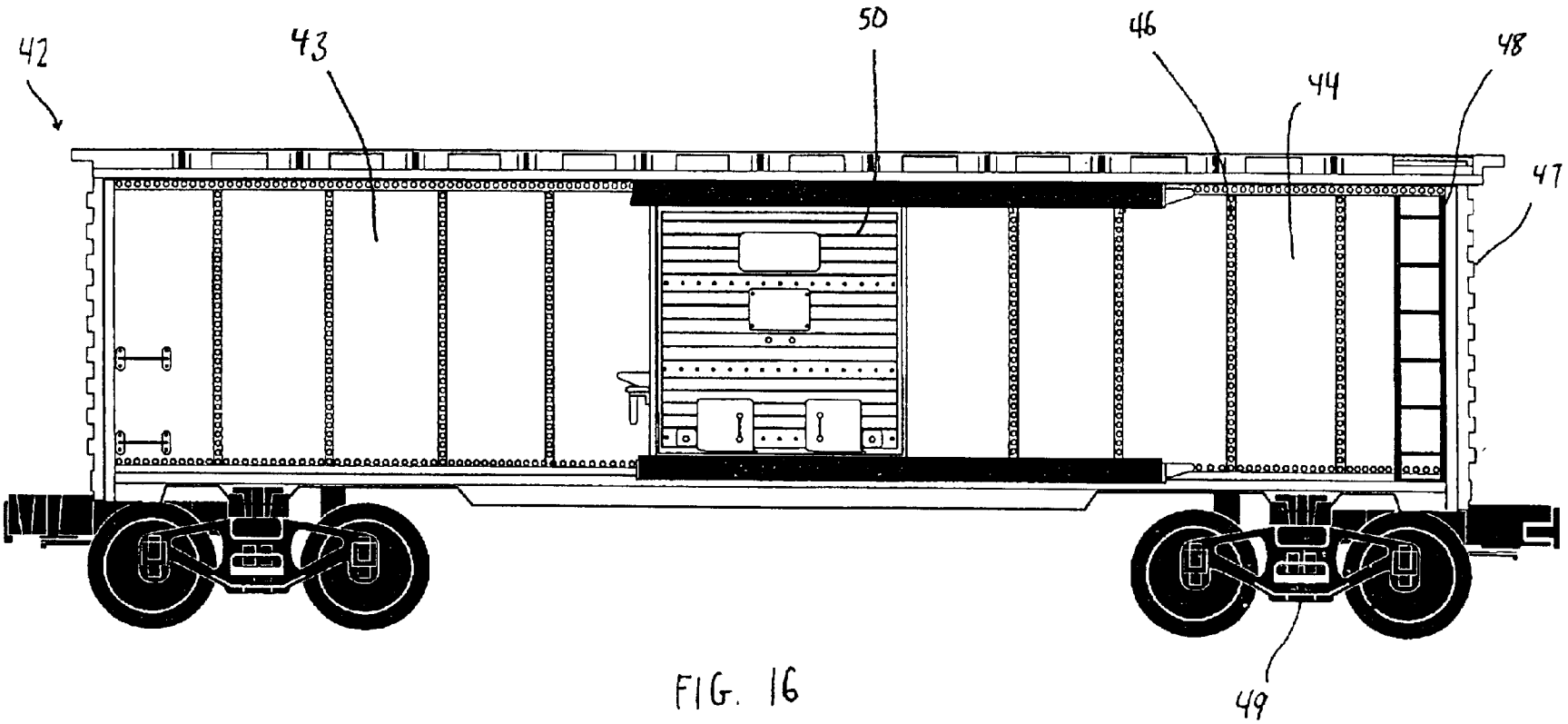
FIG. 16 is a side elevational view of a model train boxcar in accordance with a further embodiment of the present invention.
Figure 17:
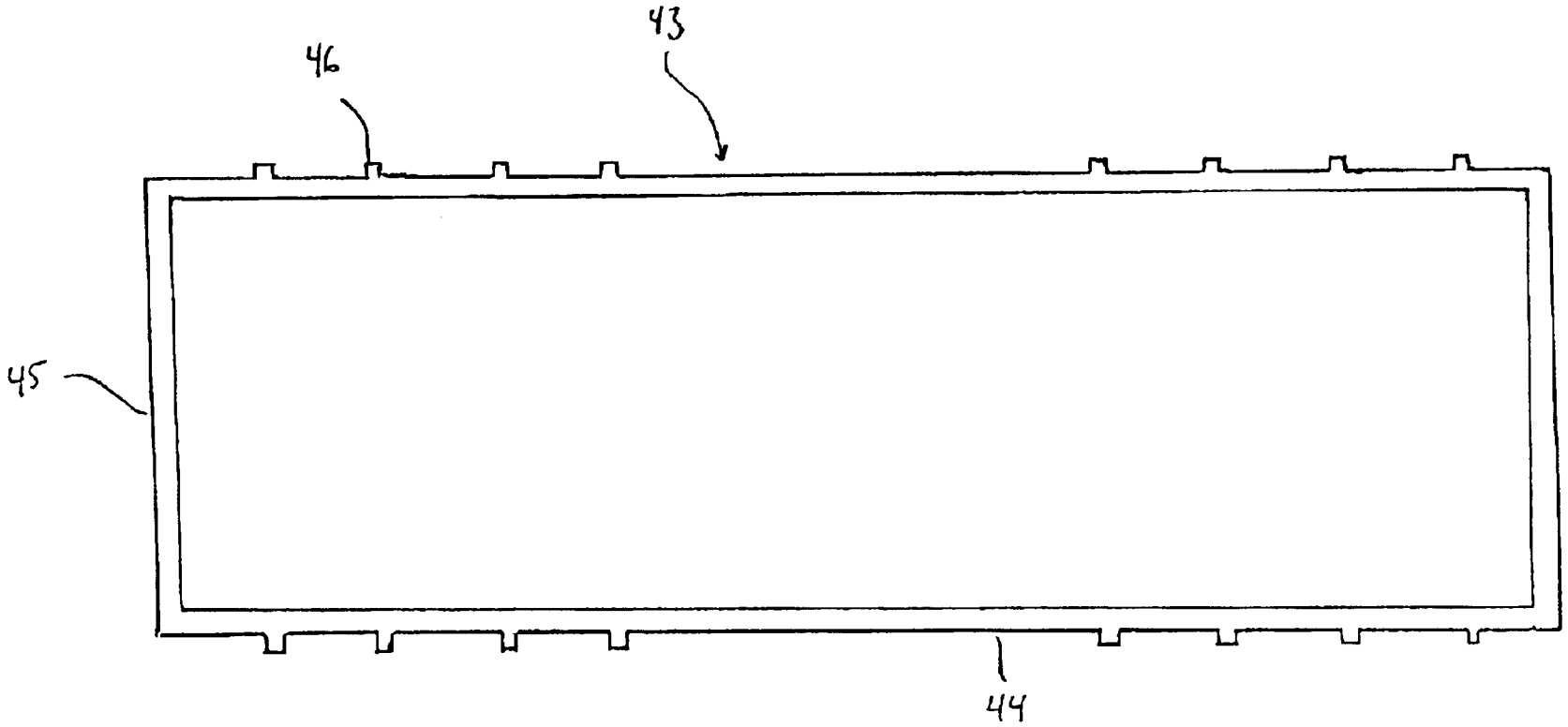
FIG. 17 is a top plan view of the extruded body of the extruded model boxcar of FIG. 16.

FIG. 16 shows a side elevational view of a model train boxcar 42 in accordance with a further embodiment of the-present invention, and FIG. 17 shows a top plan view of an extruded body 43 of the extruded model boxcar 42 of FIG. 16. The boxcar of FIGS. 16 and 17 has a body that is extruded vertically, i.e., the side 44 and end 45 walls of the model freight car body are formed during the extrusion process. In the previous embodiments, the car body is preferably extruded along the longitudinal axis of the car body. However, the car body can also be extruded perpendicular to the longitudinal axis. The vertical extrusion process enables the formation of vertical ribs 46 in the extruded body 43. A roof and floor can be attached to the body by conventional methods known in the art. Preferably, end pieces 47 are attached to the ends of the boxcar body. Other accessories, such as ladders 48, trucks 49 and a door 50 can also be added. Although a boxcar is shown in FIGS. 16 and 17, other non-passenger cars, for example, a caboose, can be formed with the vertical extrusion process.

As compared to conventional model freight or other non-passenger car manufacturing methods, the extrusion process creates a very smooth and appealing appearance. The extruded aluminum freight car body is free from flow lines, seams, or other deformities.

It is noted that the description above primarily discusses freight cars. However, the present invention is also applicable to other types of model train non-passenger cars, for example, model train cars.

The above description should not be construed as limitations on the scope of the invention. For example, the use of aluminum extrusion is not limited to the depicted hopper car and tank car illustrated, but this process can be applied to other types of model train freight or other non-passenger cars.

What is claimed is:

1. A method of manufacturing a model train non-passenger car, comprising the steps of:

extruding aluminum through a die to form a model train non-passenger car body;

wherein the extruding step forms the car body in an inverted U-shape with an inside surface and an outside surface, the extruding step further forming two flanges in the car body extending longitudinally on the inside surface on each leg of the U shaped car body to secure and support a floor for the non-passenger car; and attaching at least one accessory to the model train non-passenger car body.

2. The method of claim 1, wherein the extruding step includes extruding the aluminum through the die to extrude the hopper car body parallel to a longitudinal axis of the hopper car body.

3. The method of claim 1, wherein the extruding step includes extruding the aluminum through the die to extrude the hopper car body perpendicular to a longitudinal axis of the hopper car body.

4. A method of manufacturing a model train non-passenger car, comprising the steps of:

extruding aluminum through a die to form an extrusion defining a one piece hopper car body including a top and side walls having an upper portion and a lower portion;

cutting the side walls after said extruding step such that the upper portion of the side walls at each end of the car body extends farther longitudinally than the lower portion of the side walls; and attaching at least one accessory to the model train non-passenger car body.

5. The method of claim 4, further comprising forming at least one of holes and slots in the hopper car body for connection with corresponding projections of the at least one accessory.

6. A method of manufacturing a model train non-passenger car, comprising the steps of:

extruding aluminum through a die to form an extrusion defining a one-niece model train tank car body including a top and sides, said extruding step forming the tank car body as an elongated cylinder with open ends;

attaching at least one accessory to the model train tank car body by screwing the at least one accessory into corresponding holes in the tank car body; and screwing end caps into the ends of the tank car body.

7. A model train non-passenger car, comprising:

a one-piece model train non-passenger car body, including a top and sides, formed by extruding aluminum, wherein the model train non-passenger car is a model train freight car and the model train non-passenger car body is a model train freight car body, and wherein the freight car is a hopper car and the freight car body is a hopper car body, and wherein the freight car body has an inverted U-shape with an inside surface and an outside surface, the freight car body having two flanges extending longitudinally on the inside surface on each leg of the U shaped freight car body, the flanges being adapted to secure and support a floor for the hopper car; and at least one accessory attached to the non-passenger car body.

8. The model train non-passenger car of claim 7, wherein the freight car body has side walls having an upper portion and a lower portion, the upper portion of the side walls at each end of the freight car body extending farther longitudinally than the lower portion of the side walls.

9. The model train non-passenger car of claim 7, wherein the one-piece model train non-passenger car body has a top surface and at least one longitudinal groove in the top surface, the at least one accessory being a roof with at least one projection for attachment with the at least one longitudinal groove.

10. The model train non-passenger car of claim 7, wherein the one-piece model train non-passenger car body has at least one of holes and slots for connection with corresponding projections of the at least one accessory.

11. The model train non-passenger car of claim 7, wherein the one-piece model train non-passenger car body has side walls and end walls.

12. The model train non-passenger car of claim 11, wherein the sides side walls have vertical ribs.

13. The model train non-passenger car of claim 7, wherein the one-piece model train non-passenger car is an O-gauge car with a weight sufficient to prevent the freight car being pulled off a track by a locomotive while the car is on a curve.

14. The model train non-passenger car of claim 13, wherein the car is a freight car with a weight of about 1 lbs. to 1.75 lbs.

15. The model train non-passenger car of claim 13, wherein the car is a freight car with a weight of about 1.2 lbs.

16. The model train non-passenger car of claim 13, wherein the car is a freight car with a weight of about 1.4 lbs.

* * * * *